United States Patent [19]

Miller

[11] 4,424,784

[45] Jan. 10, 1984

[54] MANUALLY ADJUSTABLE APPARATUS AND SYSTEM FOR SELECTIVELY CONTROLLING THE AIR-FUEL RATIO SUPPLIED TO A COMBUSTION ENGINE

[75] Inventor: Robert J. Miller, Warren, Mich.

[73] Assignee: Colt Industries Operating Corp, New York, N.Y.

[21] Appl. No.: 246,876

[22] Filed: Mar. 23, 1981

[51] Int. Cl.[3] ..... F02B 33/00; F02M 7/00

[52] U.S. Cl. ..... 123/438; 123/478; 123/440; 73/113; 73/114

[58] Field of Search ..... 123/438, 478, 440, 442; 73/113, 114

[56] References Cited

U.S. PATENT DOCUMENTS

| | | | |
|---|---|---|---|
| 4,112,492 | 9/1978 | Summers | 73/114 |
| 4,140,088 | 2/1979 | de Vulpillieres | 123/478 |
| 4,212,195 | 7/1980 | Young | 73/114 |
| 4,245,603 | 1/1981 | Pomerantz | 123/440 |
| 4,269,156 | 5/1981 | Drellishok | 123/478 |
| 4,286,324 | 8/1981 | Ingram | 73/114 |
| 4,294,282 | 10/1981 | McCabe et al. | 123/438 |
| 4,314,535 | 2/1982 | Takenchi et al. | 123/438 |
| 4,320,732 | 3/1982 | Schnürlo et al. | 123/478 |

*Primary Examiner*—Raymond A. Nelli

*Attorney, Agent, or Firm*—Walter Potoroka, Sr.

[57] ABSTRACT

A vehicle has a combustion engine, ground-engaging drive wheels, a power transmission for conveying power from the engine to the wheels, an induction passage for supplying motive fluid to the engine, a source of fuel, a fuel metering system communicating generally between the source of fuel and the induction passage, a valving arrangement in the fuel metering system effective to controllably alter the rate of metered fuel flow through the fuel metering system, and a manually controlled adjustment operatively connected to the valving arrangement, the manually controlled adjustment being effective to selectively control the valving arrangement in order to thereby selectively alter the rate of metered fuel flow to the engine.

23 Claims, 6 Drawing Figures

MANUALLY ADJUSTABLE APPARATUS AND SYSTEM FOR SELECTIVELY CONTROLLING THE AIR-FUEL RATIO SUPPLIED TO A COMBUSTION ENGINE

FIELD OF THE INVENTION

This invention relates generally to fuel metering systems for use with combustion engines and more particularly to a fuel metering system wherein the rate of flow of metered fuel can be manually selected during any condition of engine operation.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of governments to be insufficient. Further, such levels of government have also imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, the available technology employable in attempting to atain increases in engine fuel economy is, generally, contrary to that technology employable in attempting to meet the governmentally imposed standards on exhaust emissions For example, the prior art, in trying to meet the standards for $NO_x$ emissions, has employed a system of exhaust gas recirculation whereby at least a portion of the exhaust gas is re-introduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for burning.

The prior art has also proposed the use of fuel metering means which are effective for metering a relatively overly-rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust, which, in turn, requires the supplying of additional oxygen, as by an associated air pump, to such engine exhaust in order to complete the oxidation of the CO and HC prior to its delivery into the atmosphere.

The prior art has also heretofore proposed retarding of the engine ignition timing as a further means for reducing the creation of $NO_x$. Also, lower engine compression ratios have been employed in order to lower the resulting combustion temperature within the engine combustion chamber and thereby reduce the creation of $NO_x$.

The prior art has also proposed the use of fuel metering injection means instead of the usually-employed carbureting apparatus and, under superatmospheric pressure, injecting the fuel into either the engine intake manifold or directly into the cylinders of a piston type internal combustion engine. Such fuel injection system, besides being costly, have not proven to be generally successful in that the system is required to provide metered fuel flow over a very wide range of metered fuel flows. Generally, those injection system which are very accurate at one end of the required range of metered fuel flows, are relatively inaccurate at the opposite end of that same range of metered fuel flows. Also, those injection systems which are made to be accurate in the mid-portion of the required range of metered fuel flows are usually relatively inaccurate at both ends of that same range. The use of feedback means for altering the metering characteristics of a particular fuel injection system have not solved the problem because the problem usually is intertwined with such factors as: effective aperture area of the injector nozzle; comparative movement required by the associated nozzle pintle or valving member; inertia of the nozzle valving member and nozzle "cracking" pressure (that being the pressure at which the nozzle opens) As should be apparent, the smaller the rate of metered fuel flow desired, the greater becomes the influence of such factors thereon.

It is anticipated that the said various levels of government will establish even more stringent exhaust emission limits and even higher standards of fuel economy.

The prior art, in view of such anticipated requirements with respect to $NO_x$, has suggested the employment of a "three-way " catalyst, in a single bed, within the stream of exhaust gases as a means of attaining such anticipated exhaust emission limits. Generally, a "three-way" catalyst (as opposed to the "two-way" catalyst system also well known in the prior art) is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel), the $NO_x$ will be reduced effectively, but the oxidation of CO will be incomplete On the other hand, if the fuel metering is too lean, the CO will be effectively oxidized but the reduction of $NO_x$ will be incomplete. Obviously, in order to make such a "three-way" catalyst system operative, it is necessary to have very accurate control over the fuel metering function of associated fuel metering supply means feeding the engine. As hereinafter described, the prior art has suggested the use of fuel injection means with associated feedback means (responsive to selected indicia of engine operating conditions and parameters) intended to continuously alter or modify the metering characteristics of the fuel injection means. However, at least to the extent hereinafter indicated, such fuel injection systems have not proven to be successful.

It has also heretofore been proposed to employ fuel metering means, of a carbureting type, with closed loop feedback means responsive to the presence of selected constituents comprising the engine exhaust gases. Such closed loop feedback means were employed to modify the action of a main metering rod of a main fuel metering system of a carburetor. However, tests and experience have indicated that such a prior art carburetor with such a related closed loop feedback means could not provide the degree of accuracy required in the metering of fuel to an associated engine as to assure meeting, for example, the said anticipated emission and fuel economy standards.

Also, heretofore, the prior art has proposed an arrangement whereby a carburetor, having an induction passage therethrough with a venturi therein and a main fuel discharge nozzle situated generally within the venturi, has a main fuel metering system communicating generally between a fuel reservoir and the main fuel discharge nozzle along with an idle fuel metering system communicating generally between a fuel reservoir and said induction passage at a location generally in close proximity to an edge of a variably openable throttle valve situated in the induction passage downstream of the main fuel discharge nozzle. Modulating valving means are provided to controllably alter the rate of metered fuel flow through each of the main and idle fuel metering systems in response to control signals generated as a consequence of selected indicia of engine operation. Such indicia comprised engine exhaust gas constituent responsive means for sensing the relative percentage of selected exhaust gas constituents and producing control signals in response thereto. Also, electronic computer means are usually provided for processing all of the control signals and, in response thereto, producing an output signal or signals effective for controlling the modulating valving means.

In the main, such prior art systems can not be readily adapted to all engines and vehicles especially where such engines and/or vehicles were manufactured prior to the commercial availability of such prior art fuel metering systems.

Accordingly, the invention as herein disclosed is primarily directed to the provision of a fuel metering system which can be readily adapted to all engines and vehicles and which, further, enables the vehicle operator a certain degree of control thereover in order to be able to select, for example, the rate of metered fuel flow to the engine in order to obtain maximum fuel economy for whatever engine demands are being then experienced.

SUMMARY OF THE INVENTION

According to the invention a fuel metering system for a vehicle having a combustion engine, ground-engaging drive wheel means, and power transmission means for conveying power from said engine to said drive wheel means, comprises induction passage means for supplying motive fluid to said engine, a source of fuel, main fuel metering system means communicating generally between said source of fuel and said induction passage means, idle fuel metering system means communicating generally between said source of fuel and said induction passage means, selectively controlled modulating valving means effective to controllably alter the rate of metered fuel flow through each of said main fuel metering system means and said idle fuel metering system means, and manually controlled adjustment means operatively connected to said modulating valving means, said manually controlled adjustment means being effective to selectively control said modulating valving means in order to thereby selectively alter said rate of metered fuel flow to said engine.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
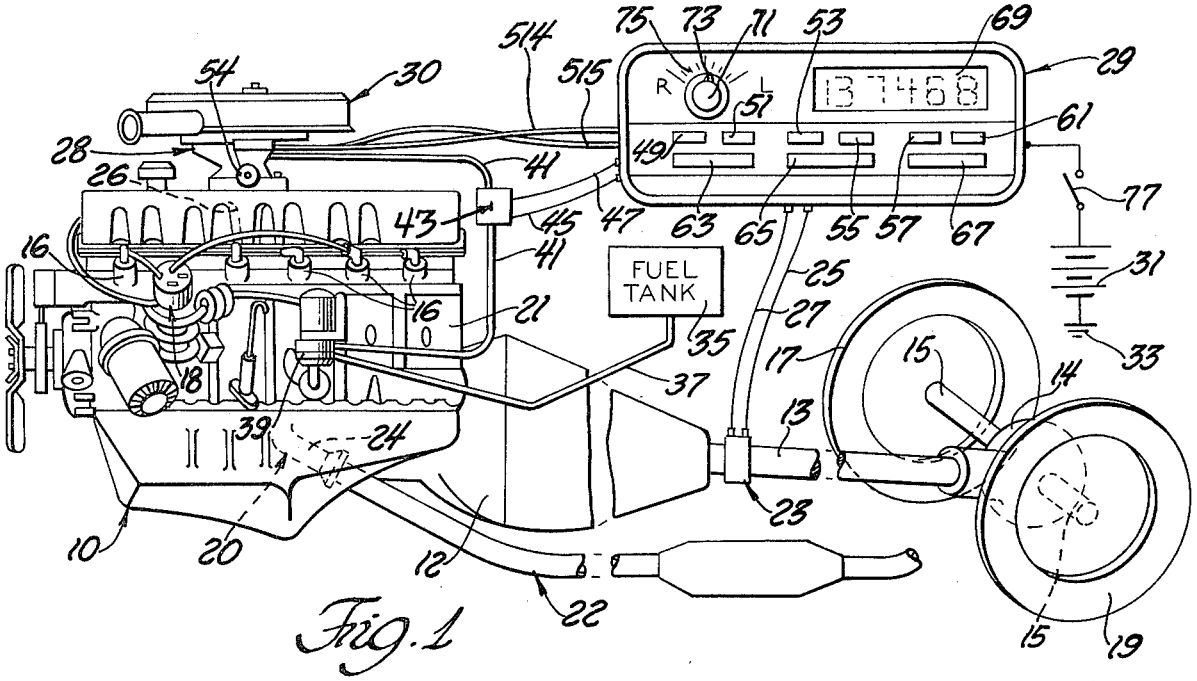
FIG. 1 illustrates, in side elevational view, a fragmentary portion of a vehicle equipped with a vehicular combustion engine employing a carbureting apparatus and related control system employing teachings of the invention.

Referring now in greater detail to the drawings, FIG. 1 illustrates a combustion engine 10 used to propel an associated vehicle as through power output transmission means 12, drive or propeller shaft 13, differential gearing assembly 14, drive axle means 15 and ground engaging drive wheels 17 and 19. The engine 10 may, for example, be of the internal combustion type employing, as is generally well known in the art, a plurality of power piston means therein. As generally depicted, the engine assembly 10 is shown as being comprised of an engine block 21 containing, among other things, a plurality of cylinders respectively reciprocatingly receiving said power pistons therein. A plurality of spark or ignition plugs 16, as for example one for each cylinder, are carried by the engine block and respectively electrically connected to an ignition distributor assembly or system 18 operated in timed relationship to engine operation.

As is generally well known in the art, each cylinder containing a power piston has exhaust aperture or port means and such exhaust port means communicate as with an associated exhaust manifold which is fragmentarily illustrated in hidden line at 20. Exhaust conduit means 22 is shown operatively connected to the discharge end 24 of exhaust manifold 20 and leading as to the rear of the associated vehicle for the discharging of exhaust gases to the atmosphere.

Further, as is also generally well known in the art, each cylinder which contains a power piston also has inlet aperture means or port means and such inlet aperture means communicate as with an associated inlet manifold which is fragmentarily illustrated in hidden line at 26.

As generally depicted, a carbureting type fuel metering apparatus 28 is situated atop a cooperating portion of the inlet or intake manifold means 26. A suitable inlet air cleaner assembly 30 may be situated atop the carburetor assembly 28 to filter the air prior to its entrance into the inlet of the carburetor 28.

Figure 2:
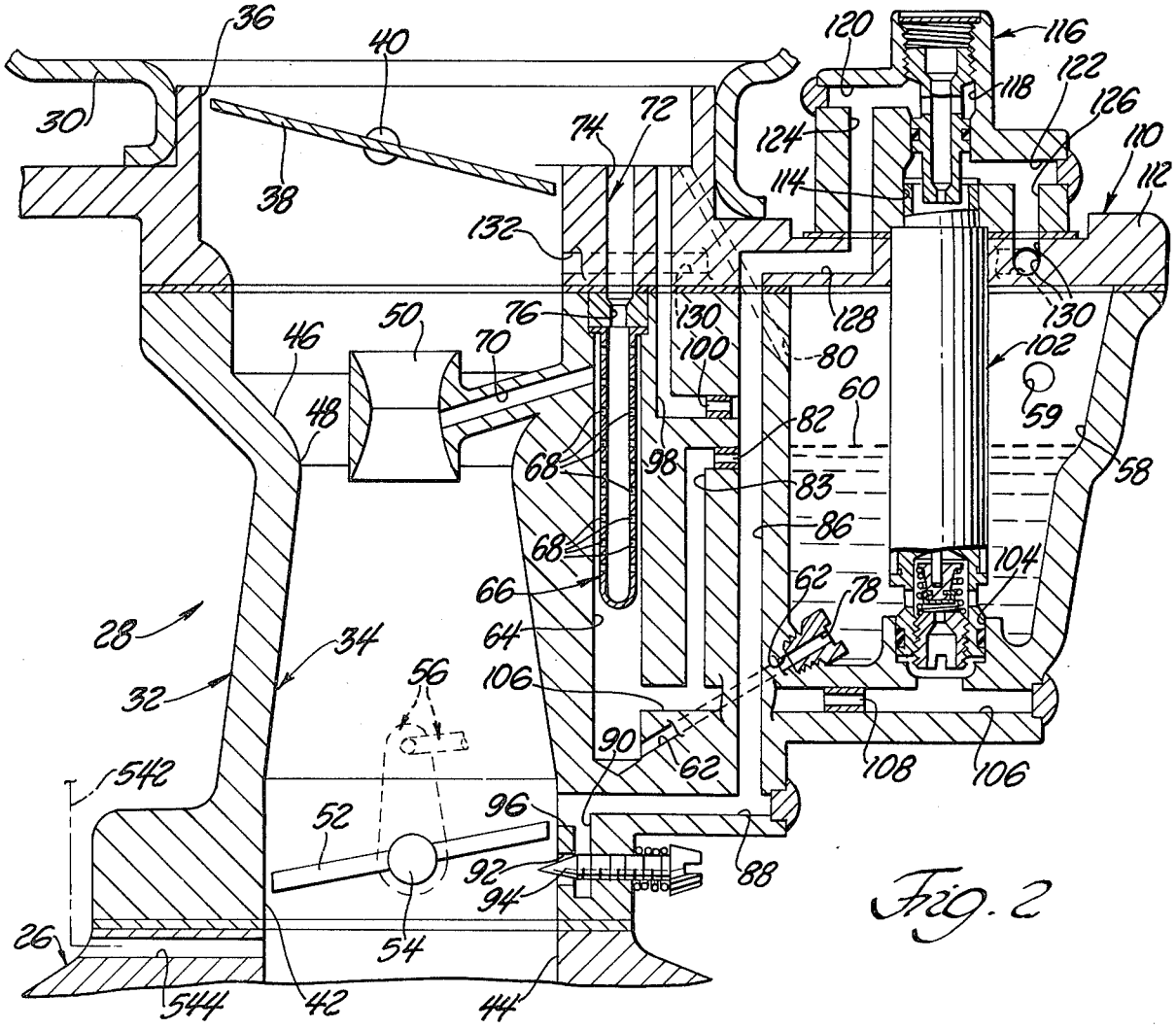
FIG. 2 is an enlarged view, in cross-section, of the carbureting apparatus of FIG. 1.

FIG. 2 illustrates the carburetor 28, employing teachings of the invention, as comprising a main carburetor body 32 having induction passage means 34 formed therethrough with an upper inlet end 36, in which generally is situated a variably openable choke valve 38 carried as by a pivotal choke shaft 40, and a discharge end 42 communicating as with the inlet 44 of intake manifold 26. A venturi section 46, having a venturi throat 48, is provided within the induction passage means 34 generally between the inlet 36 and outlet or discharge end 42. A main metering fuel discharge nozzle 50, situated generally within the throat 48 of venturi section 46, serves to discharge fuel, as is metered by the main metering system, into the induction passage means 34.

A variably openable throttle valve 52, carried as by a rotatable throttle shaft 54, serves to variably control the discharge and flow of combustible (fuel-air) mixtures into the inlet 44 of intake manifold 26. Suitable throttle control linkage means, as generally depicted at 56, is provided and operatively connected to throttle shaft 54 in order to affect throttle positioning in response to vehicle operator demand.

Carburetor body means 32 may be formed as to also define a fuel reservoir chamber 58 adapted to receive, as through inlet means 59, and contain fuel 60 therein the level of which may be determined as by, for example, a float operated fuel inlet valve assembly, as is generally well known in the art.

The main fuel metering system comprises passage or conduit means 62 communicating generally between fuel chamber 58 and a generally upwardly extending main fuel well 64 which, as shown, may contain a main well tube 66 which, in turn, is provided with a plurality of generally radially directed apertures 68 formed through the wall thereof as to thereby provide for communication as between the interior of the tube 66 and the portion of the well 64 generally radially surrounding the tube 66. Conduit means 70 serves to communicate between the upper part of well 64 and the interior of discharge nozzle 50. Air bleed type passage means 72, comprising conduit means 74 and calibrated restriction or metering means 76, communicates as between a source of filtered air and the upper part of the interior of well tube 66. A main calibrated fuel metering restriction 78 is situated generally upstream of well 64, as for example in conduit means 62, in order to meter the rate of fuel flow from chamber 58 to main well 64. As is generally well known in the art, the interior of fuel reservoir chamber 58 is preferably pressure vented to a source of generally ambient air as by means of, for example, vent-like passage means 80 leading from chamber 58 to the inlet end 36 of induction passage 34.

Generally, when the engine is running, the intake stroke of each power piston causes air flow through the induction passage 34 and venturi throat 48. The air thusly flowing through the venturi throat 48 creates a low pressure commonly referred to as a venturi vacuum. The magnitude of such venturi vacuum is determined primarily by the velocity of the air flowing through the venturi and, of course, such velocity is determined by the speed and power output of the engine. The difference between the pressure in the venturi and the air pressure within fuel reservoir chamber 58 causes fuel to flow from fuel chamber 58 through the main metering system. That is, the fuel flows through metering restriction 78, conduit means 62, up through well 64 and, after mixing with the air supplied by the main well air bleed means 72, passes through conduit means 70 and discharges from nozzle 50 into induction passage means 34. Generally, the calibration of the various controlling elements are such as to cause such main metered fuel flow to start to occur at some predetermined differential between fuel reservoir and venturi pressure. Such a differential may exist, for example, at a vehicular speed of 30 m.p.h. at normal road load.

Engine and vehicle operation at conditions less than that required to initiate operation of the main metering system are achieved by operation of the idle fuel metering system, which may not only supply metered fuel flow during curb idle engine operation but also at off idle operation.

At curb idle and other relatively low speeds of engine operation, the engine does not cause a sufficient rate of air flow through the venturi section 48 as to result in a venturi vacuum sufficient to operate the main metering system. Because of the relatively almost closed throttle valve means 52, which greatly restricts air flow into the intake manifold 26 at idle and low engine speeds, engine or intake manifold vacuum is of a relatively high magnitude. This high manifold vacuum serves to provide a pressure differential which operates the idle fuel metering system.

Generally, the idle fuel system is illustrated as comprising calibrated idle fuel restriction metering means 82 and passage means 83 communicating as between a source of fuel, as within, for example, the fuel well 64, and a generally upwardly extending passage or conduit 86 the lower end of which communicates with a generally laterally extending conduit 88. A downwardly depending conduit 90 communicates at its upper end with conduit 88 and at its lower end with induction passage means 34 as through aperture means 92. The effective size of discharge aperture 92 is variably established as by an axially adjustable needle valve member 94 threadably carried by body 32. As generally shown and as generally known in the art, passage 88 may terminate in a relatively vertically elongated discharge opening or aperture 96 located as to be generally juxtaposed to an edge of throttle valve 52 when such throttle valve 52 is in its curb-idle or nominally closed position. Often, aperture 96 is referred to in the art as being a transfer slot effectively increasing the area for flow of fuel to the underside of throttle valve 52 as the throttle valve is moved toward a more fully opened position.

Conduit means 98, provided with calibrated air metering or restriction means 100, serves to communicate as between an upper portion of conduit 86 and a source of atmospheric air as at the inlet end 36 of induction passage 34.

At idle engine operation, the greatly reduced pressure area below the throttle valve means causes fuel to flow as from the fuel reservoir 58 and well 64 through conduit means 83 and restriction means 82 and generally intermixes with the bleed air provided by conduit 98 and air bleed restriction means 100. The fuel-air emulsion then is drawn downwardly through conduit 86 and through conduits 88 and 90 ultimately discharged, posterior to throttle valve 52, through the effective opening of aperture 92.

During off-idle operation, the throttle valve means 52 is moved in the opening direction causing the juxtaposed edge of the throttle valve to further effectively open and expose a greater portion of the transfer slot or port means 96 to the manifold vacuum existing posterior to the throttle valve. This, of course, causes additional metered idle fuel flow through the transfer port means 96. As the throttle valve means 52 is opened still wider and the engine speed increases, the velocity of air flow through the induction passage 34 increases to the point where the resulting developed venturi vacuum is sufficient to cause the hereinbefore described main metering system to be brought into operation.

The invention as herein disclosed and described provides means, in addition to those hereinbefore described, for controlling and/or modifying the metering characteristics otherwise established by the fluid circuit constants previously described. In the embodiment disclosed, among other cooperating elements, solenoid valving means 102 is provided to enable the performance of such modifying and/or control functions.

The solenoid valving means 102 is illustrated in greater detail in FIG. 3 and the detailed description thereof will hereinafter be presented in regard to the consideration of said FIG. 3. However, at this point, and still with reference to FIG. 2, it will be sufficient to point out that, in the embodiment disclosed, the solenoid means or assembly 102 has an operative upper end and an operative lower end and that such means or assembly 102 is preferably carried by the carbureting body means as, for example, to be partly received by the fuel reservoir 58. As generally depicted in FIG. 2, the lower operative end of solenoid valving means or assembly 102 is operatively received as by an opening 104 formed as in the interior of fuel reservoir 58 with such opening 104 generally, in turn, communicating with passage means 106 leading to the main fuel well 64. In fact, as also depicted, the idle fuel passage 83 may communicate with main well 64 through a portion of such passage means 106 which is preferably provided with calibrated restriction means 108.

The carbureting means 28 may be comprised of an upper disposed body or housing section 110 provided as with a cover-like portion 112 which serves to in effect cover the fuel reservoir 58. As also depicted in FIG. 2, the upper end of solenoid assembly 102 may be generally received through cover section 112 as to have the upper end of assembly 102 received as by an opening 114 formed as within a cap-like housing or body portion 116 which has a relatively enlarged passage or chamber 118 formed therein and communicating with laterally extending passages or conduits 120 and 122 which, in turn, respectively communicate with illustrated downwardly extending passage or conduits 124 and 126. A conduit 128, formed in housing section 110, serves to interconnect and complete communication as between the lower end of conduit 124 and the upper end of conduit 86, while a second conduit 130, also formed in housing section 110, serves to interconnect and complete communication as between the lower end of conduit 126 and a source of ambient atmosphere as, preferably, at a point in the air inlet end of induction passage means 34. Such may take the form of an opening 132, communicating with passage means 34, situated generally downstream of choke or air valve means 38.

Figure 3:
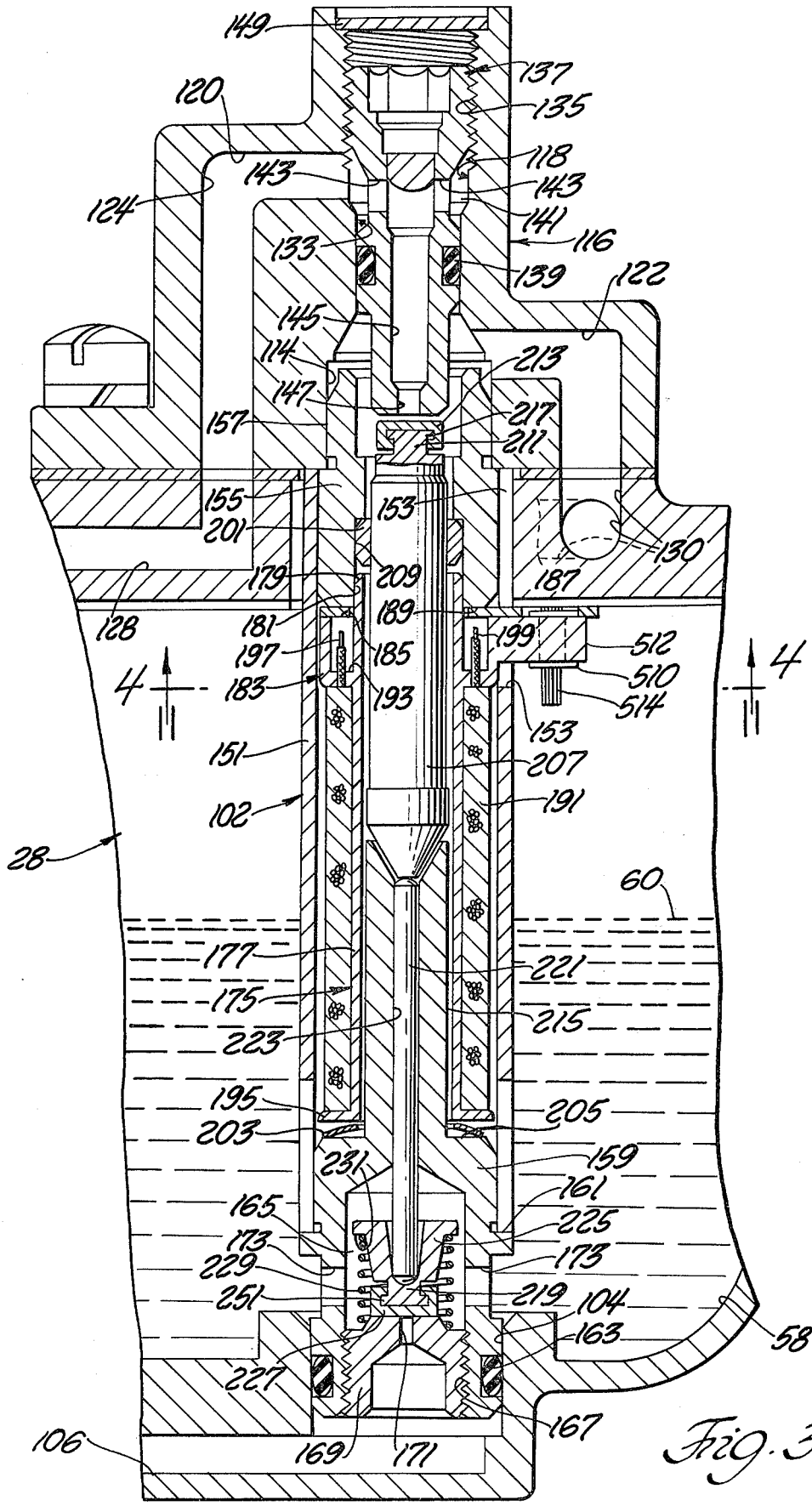
FIG. 3 is an enlarged axial cross-sectional view of one of the elements shown in FIG. 2 with fragmentary portions of related structure also shown in FIG. 2.

Referring in greater detail to both FIGS. 2 and 3, and in particular to FIG. 3, chamber 118 of housing portion 116 is shown as having a cylindrical passage portion 133 with an axially extending section thereof being internally threaded as at 135 in order to threadably engage a generally tubular valve seat member 137 which has its inner-most end provided with an annular seal, such as an O-ring, 139 thereby sealing such inner-most end of member 137 against the surface of cylindrical passage portion 133. As depicted, valve seat member 137 is generally necked-down at its mid-section thereby providing for an annular chamber 141 thereabout with such annular chamber 141 being, of course, partly defined by a cooperating portion of chamber or passage means 118. A plurality of generally radially directed apertures or passages 143 serve to complete communication as between annular chamber 141 and an axially extending conduit 145, formed in the body of valve seat member 137, which, in turn, communicates with a valve seat calibrated orifice or passage 147. After the valve seat member 137 is threadably axially positioned in the selected relationship, a suitable chamber closure member 149 may be placed in the otherwise open end of chamber 118.

The solenoid assembly 102 is illustrated as comprising a generally tubular outer case 151 the upper end of which is slotted, as depicted at 153, and receives an upper end sleeve member 155 which may be secured to the outer case or housing 151 as by, for example, having the end member 155 pressed into the housing 151 and then further crimping housing 151 against member 155. The outer surface 157 of the upper end of sleeve member 155 is closely received within cooperating receiving opening 114.

A generally lower disposed end sleeve member 159 may be similarly received by the lower open end of case or housing 151 and suitably secured thereto as by, for example, crimping. Preferably, sleeve member 159 is provided with a flange portion 161 against which the end of case 151 may axially abut. The lower-most end of sleeve member 159 is closely received within cooperating opening or passage 104 and is provided with an annular groove or recess which, in turn, receives and retains a seal, such as, for example, an "O"-ring, 163 which serves to assure such lower-most portion of sleeve 159 being peripherally sealed against the surface of opening 104. A generally medially situated chamber 165, formed in sleeve member 159 is preferably provided with an internally threaded portion 167 which threadably engages a threadably axially adjustable valve seat member 169 which, in turn, is provided with a calibrated valve orifice or passageway 171 effective for communicating as between chamber 165 and passage or conduit means 106. A plurality of generally radially directed apertures or passages 173 serve to complete communication as between chamber 165 and the interior of the fuel reservoir 58.

A spool-like member 175 has an axially extending cylindrical tubular portion 177 the upper end 179 of which is closely received within a cooperating recess-like aperture 181 provided by upper sleeve member 155. Near the upper end of spool member 175, such member is provided with a generally cylindrical cup-like portion 183 which, in turn, defines an upper disposed abutment or axial end mounting surface 185 which abuts as against a flat insulating member 187 situated against the lower end surface 189 of upper sleeve member 155 and about the upper portion 179 of tubular portion 177. An electrical coil or winding 191, carried generally about tubular portion 177 and between axial end walls 193 and 195 of spool 175, may have its leads 197 and 199 pass as through wall portion 193 for connection to related circuitry, to be described. An annular bowed spring 203 is axially contained between end wall 195 of spool 175 and the upper face 205 of lower sleeve member 159 and serves to resiliently hold the spool and coil assembly (175 and 191) in its depicted assembled condition within case or housing 151.

A cylindrical armature 207, slidably reciprocatingly received within tubular portion 177 and aligned passageway 209, formed as in a bushing member 201 situated in sleeve member 155, has an upper disposed axial extension 211 and an integrally formed annular flange-like portion 217 which internally engage and both laterally and axially retain a related, at least somewhat resilient, generally cup-like valve member 213.

Somewhat similarly, the lower end of armature 207 is in operative abutting engagement with an axial extension, such as a pin or rod 221 which passes through a clearance passageway 223, formed in lower sleeve member 159, (including its tubular extension 215 received with tubular portion 177 of spool 175) and abutably engages a lower disposed valving member 225 which is provided with an axial extension 219 and integrally formed annular flange 251 which internally engage and laterally and axially retain, at least a somewhat resilient, generally cup-like valve member 227. A compression spring 229 has one end seated as against valve seat member 169 and its other end seated against a suitable flange portion 231 of valving member 225 as to thereby normally yieldingly urge the valve member 227 and armature 207 axially away from the valve seat member 169 (that being the opening direction for valve passageway 171).

As should be apparent, upon energization and de-energization of the coil 191, armature 207 will experience reciprocating motion with the result that, in alternating fashion, valve member 213 will close and open calibrated passageway 147 while valve member 227 will open and close calibrated passageway 171.

Without, at this point, considering the overall operation, it should now be apparent that when, for example, armature 207 is in its upper-most position and valve member 227 has fully closed passageway or orifice 147, all communication between conduits 120 and 122 is terminated. Therefore, the only source for any bleed air, to be mixed with raw or solid fuel being drawn through conduit means 83 (to thereby create the fuel-air emulsion previously referred to herein), is through bleed air passage 98 and calibrated bleed air restriction means 100 (FIG. 2). The ratio of fuel-to-air in such an emulsion (under such an assumed condition) will be determined by the restrictive quality of air bleed restriction means 100, alone.

However, let it be assumed that armature 207 has moved to its lower-most position, as depicted, and that valve member 213 has, thereby, fully opened calibrated passageway 147. Under such an assumed condition, it can be seen that communication, via passage or orifice 147, is completed as between conduits 120 and 122 with the result that now, the top of conduit 86 (FIG. 2) is in controlled (by virtue of the restrictive qualities or characteristics occurring at passageway 147) communication with a source of ambient atmosphere via conduits 128, 124, 120, 143, 145, 147, 122, 126 and 130 and opening 132 (FIG. 2). Accordingly, it can be seen that under such an assumed condition the source for bleed air, to be mixed with raw or solid fuel being drawn through conduit means 83 (to thereby create the fuel-air emulsion hereinbefore referred to), is through both bleed air passage 98 and restriction means 100 as well as conduit means 130 as set forth above. Therefore, it can be readily seen that under such an assumed condition significantly more bleed-air will be available and the resulting ratio of fuel-to-air in such an emulsion will be accordingly significantly leaner (in terms of fuel) than the fuel-to-air ratio obtained when only conduit 98 and restriction 100 were the sole source of bleed air.

Obviously, the two assumed conditions discussed above are extremes and an entire range of conditions exist between such extremes. Further, since the armature 207 and valve member 213 will, during operation, intermittently reciprocatingly open and close passageway or orifice 147, the percentage of time, within any selected unit or span of time used as a reference, that the orifice 147 is opened will determine the degree to which such variably determined additional bleed air becomes available for intermixing with the said raw or solid fuel.

Generally, and by way of summary, with proportionately greater rate of flow of idle bleed air, the less, proportionately, is the rate of metered idle fuel flow thereby causing a reduction in the richness (in terms of fuel) in the fuel-air mixture supplied through the induction passage 34 and into the intake manifold 26. The converse is also true; that is, as aperture or orifice means 147 is more nearly totally, in terms of time, closed, the total rate of idle bleed air becomes increasingly more dependent upon the comparatively reduced effective flow area of restriction means 100 thereby proportionately reducing the rate of idle bleed air and increasing, proportionately, the rate of metered idle fuel flow and, thereby, resulting in an increase in the richness (in terms of fuel) in the fuel-air mixture supplied through induction passage 34 and into the intake manifold 26.

Further, and still without considering the overall operation of the invention, it should be apparent that for any selected metering pressure differential between the venturi vacuum, $P_v$, and the pressure, $P_a$, within reservoir 58, the "richness" of the fuel delivered by the main fuel metering system can be modulated merely by the moving of valve member 227 toward and/or away from coacting aperture means 171. That is, for any such given metering pressure differential, the greater the effective opening of aperture 171 becomes, the greater also becomes the rate of metered fuel flow since one of the factors controlling such rate is the effective area of the metering orifice means. Obviously, in the embodiment disclosed, the effective flow area of orifice means 171 is fixed; however, the effectiveness of flow permitted therethrough is related to the percentage of time, within any selected unit or span of time used as a reference, that the orifice means 171 is opened (valving means 225 and valve member 227 being moved away from passage means 171) thereby permitting an increase in the rate of fuel flow through passages 173, 165, 171 and 106 to main fuel well 64 (FIG. 2). With such opening of orifice means 171 it can be seen that the metering area of orifice means 171 is, generally, additive to the effective metering area of orifice means 78. Therefore, a comparatively increased rate of metered fuel flow is consequently discharged, through nozzle 50, into the induction passage means 34. The converse is also true; that is, the less that orifice means 171 is effectively open or opened, the total effective main fuel metering area effectively decreases and approaches that effective area determined by metering means 78. Consequently, the total rate of metered main fuel flow decreases and a comparatively decreased rate of metered fuel flow is discharged through nozzle 50 into the induction passage 34.

Referring again to FIG. 1, it can be seen that suitable vehicular speed sensing means 23 may be operatively connected to the engine power output train, as, for example, to the output or drive shaft means 13. The speed sensing means 23 is of the type which senses the speed of rotation and, in turn, produces an electrical output signal, as along conductor means 25, 27, which is of a magnitude reflective of such sensed speed. Such a speed signal is then applied, as an input signal to the control and computer means 29 which may be powered as by a suitable source of electrical potential 31 indicated as being grounded as at 33.

Figure 6:
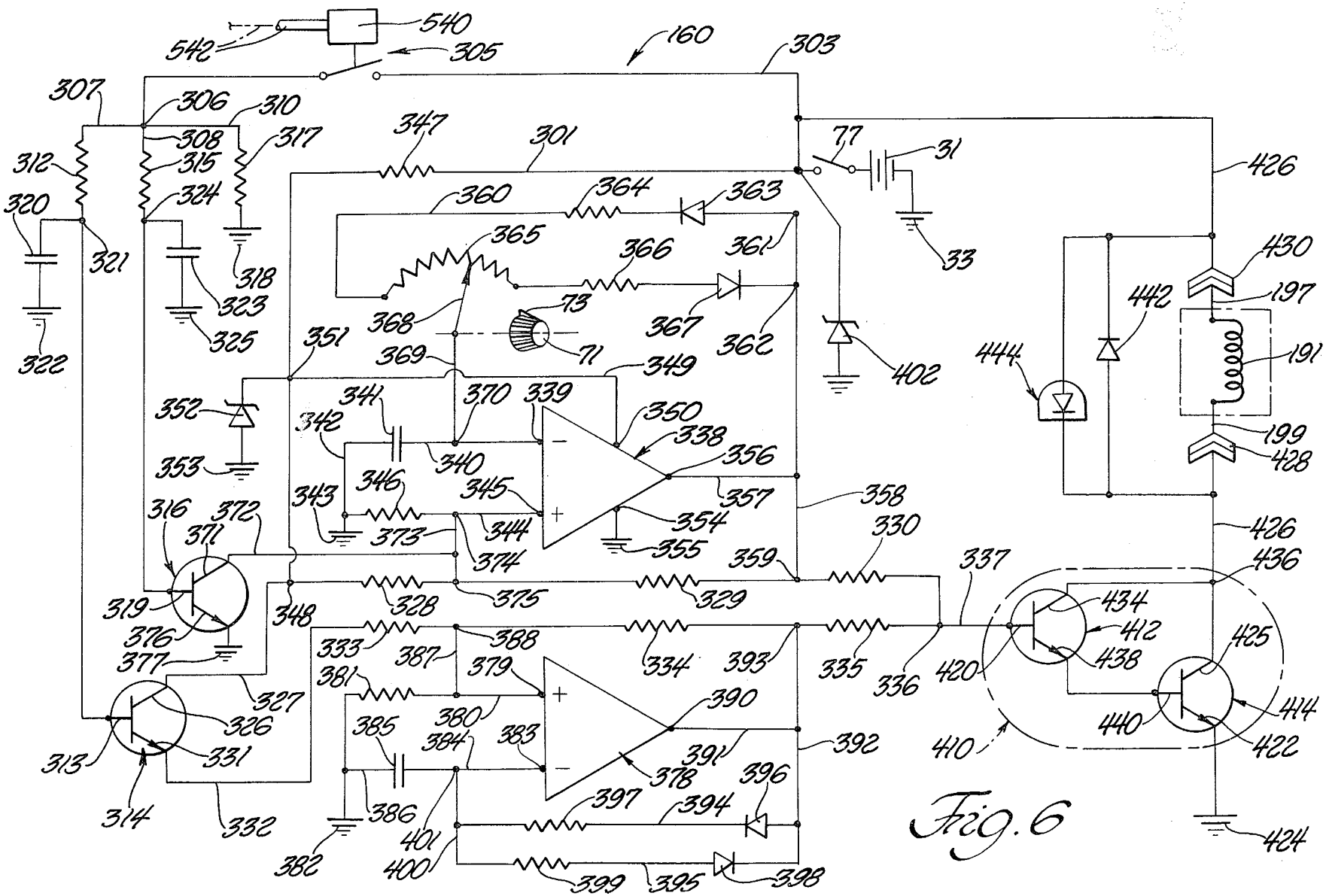
FIG. 6 is a schematic wiring diagram of circuitry employable in practicing the invention.

Although the practice of the invention is not limited to any specific form or embodiment of a control and computer means 29, it has been discovered during testing of the invention that a commercially available apparatus designated as a "ZT3 Driving Computer" and sold by Zemco, Inc. of 12907 Alcosta Blvd., San Ramon, California, U.S.A. (and also described in a publication captioned ZT3 DRIVING COMPUTER and bearing a copyright notice of 1980 by Zemco, Inc.) provides acceptable performance. Further, as will become apparent, such a commercially available control and computer 29 may be modified as by the incorporation or the addition thereto of circuit means as generally depicted in FIG. 6. That is to say, in the present disclosure, it is assumed that the means 29 as depicted in FIG. 1 includes the circuit means of FIG. 6 or the functional equivalent thereof. However, that is not to mean that the invention is limited to such a combination since the various circuits and computer means may actually be physically separated from each other and only operatively interconnected.

Similarly, even though the practice of the invention is not limited to the use of any specific form or embodiment of a speed sensing means 23, it has been discovered during testing of the invention that a commercially available apparatus designated as a portion of an overall kit comprising said "ZT3 Driving Computer" provides acceptable performance.

Still referring to FIG. 1, a vehicular fuel tank 35 is shown supplying fuel as via conduit means 37 to the inlet of an associated fuel pump 39 which, in turn, pumps such fuel as via conduit means 41 to the inlet 59 (FIG. 2) of the fuel reservoir 58 of carbureting means 28. A flow sensor means 43, illustrated as comprising a portion of the conduit means 41, senses the rate of flow, per unit of time, of fuel to the carbureting means 28, and therefore to the engine 10, and in accordance therewith produces an electrical output signal which is applied as via conductor means 45 and 47 as an input signal to the control means 29. Again, even though the practice of the invention is not limited to the use of any specific form or embodiment of a flow sensor means 43, it has been discovered during testing of the invention that a commercially available apparatus designated as a portion of an overall kit comprising said "ZT3 Driving Computer" provides acceptable performance A pair of electrical conductor means 514 and 515 are illustrated as electrically interconnecting the control means 29 and carburetor means 28, and, more specifically, the coil 191 leads 197, 199 of the solenoid valving means 102 (FIGS. 2 and 3).

In the preferred embodiment, the control means 29 would comprise suitable housing means the face of which would carry or provide suitable push-button means 49, 51, 53, 55, 57, 61, 63 65 and 67 along with a visual read-out digital display 69. Such push-buttons, when actuated, could result in the digital display providing a read-out of various bits of information. For example upon actuation of: (a) 49, the display would indicate the rate of fuel consumption in terms of miles per gallon, or the like; (b) 51, the display would indicate the vehicular speed; (c) 53, the display would indicate the elapsed time as from, for example, the beginning of a trip; (d) 55, the display would indicate the then time of day; (e) 57, the display would indicate the distance traveled as, for example, from the start of a trip; (f) 61, the display would indicate the quantity of fuel consumed as from the start of a trip; (g) 63, the display would indicate the average speed of the vehicle as, for example, from the start of a trip and (h) 65, the associated circuitry and display would be reset.

Also, in the preferred embodiment, the control means 29 would carry a manually adjustable control member 71 as in the form of, for example, a rotatable knob which may be provided with a pointer 73 so that as the control knob 71 is rotated the pointer 73 would generally sweep across or in respect to radiating graduations 75 with the left-most (as viewed in FIG. 1) thereof being designated as "Rich", or the like, and the right-most (as viewed in FIG. 1) being designated as "Lean", or the like.

Generally, as is well known, as the vehicle is being operated, the signals generated and supplied by the speed sensor means 23 and the flow sensor means 43 are integrated by the circuitry of the computer portion of the control means 29 so that, depending upon the function selected as by the actuation of a push-button, the corresponding information is presented by the digital display 69.

Referring now in greater detail to FIG. 6 wherein control circuit means 160 employable in the invention is illustrated as comprising a source of electrical potential, which may be the same source 31 as shown in FIG. 1, grounded as at 33 and having its other terminal electrically connected, as through engine ignition switch means 77, to conductor means 301 and 303. A vacuum responsive electrical switching means 305 is shown as being in series with conductor means 303 which, at its other end, may be considered as being electrically connected as at juncture means 306 to conductor means 307, 308 and 310.

The other end of conductor means 307, which comprises series resistor means 312, is electrically connected to the base terminal 313 of an N-P-N transistor 314 while the other end of conductor means 308, which comprises series resistor means 315, is electrically connected to the base terminal 319 of a second N-P-N transistor 316. Conductor means 310, illustrated as comprising series resistor means 317, is connected to ground potential as at 318.

A first capacitor means 320 has one of its electrical sides electrically connected to conductor means 307 as at a point 321 electrically between resistor means 312 and base terminal 313 of transistor 314 while its other electrical side is brought to ground as at 322. Similarly, a second capacitor means 323 has one of its electrical sides electrically connected to conductor means 308 as at a point 324 electrically between resistor means 315 and base terminal 319 of transistor 316 while its other electrical side is brought to ground as at 325.

The collector electrode or terminal 326 of transistor 314 is electrically connected to conductor means 327 which comprises series situated resistance means 328, 329 and 330 while the emitter electrode or terminal 331 of transistor 314 is electrically connected to conductor means 332 which comprises series situated resistance means 333, 334 and 335. Conductor means 327 and 332 may be electrically joined as at 336 and, in turn, electrically coupled as via conductor means 337 to the base terminal 420 of a Darlington circuit 410 which comprises N-P-N transistors 412 and 414. The emitter electrode 422 of transistor 414 is connected to ground as at 424 while the collector 425 thereof is electrically connected as by conductor means 426 connectable, as at 428 and 430, to the solenoid means 102, and leading to the related source of electrical potential as by, for example, electrical connection through conductor means 303.

The collector 434 of transistor 412 is electrically connected to conductor means 426, as at point 436, while the emitter 438 thereof is electrically connected to the base terminal 440 of transistor 414. Preferably, a diode 442 is placed in parallel with solenoid means 191. Although not essential to the practice of the invention, a light-emitting diode 444 may be provided to visually indicate the condition of operation.

A first operational amplifier 338 is illustrated as having its inverting input terminal 339 electrically connected as via conductor means 340 to one electrical side of capacitor means 341 the other electrical side of which is connected as via conductor means 342 to ground as at 343. The positive (+) terminal 345 of amplifier 338 is also connected to ground 343 as through conductor means 344 comprising series resistance means 346.

Conductor means 301, which may comprise suitable series situated resistance means 347, is electrically connected to conductor means 327 as at a point 348 generally on the collector 326 side of resistance means 328. An internal power supply conductor means 349 is electrically connected as between terminal 350 of amplifier 338 and conductor means 301 as at a point 351 thereof. A zener diode 352, grounded as at 353, may also be connected to point 351 as to thereby regulate the potential at points 351 and 348 as well as across the amplifier terminals 350 and 354 with terminal 354 being grounded as at 355.

The output terminal 356 of amplifier 338 is connected as by conductor means 357 to conductor means 358 which, at its lower end is connected to conductor means 327 as at a point 359 electrically between resistance means 329 and 330, and which at its upper portion (as viewed in FIG. 6) is connected to what may be considered a looped conductor means 360 as at points 361 and 362. In the preferred embodiment, conductor means 360 comprises series situated: diode 363, resistance means 364, potentiometer resistance means 365, resistance means 366 and diode means 367. The potentiometer wiper contact 368, positioned as by the manual control knob 71, is electrically connected, as via conductor means 369, to inverter input terminal 339 as by its connection to conductor means 340 as at a point 370 generally electrically between capacitor means 341 and terminal 339.

The collector 371 of transistor 316 is electrically connected to the positive input terminal 345 of amplifier 338 and to conductor means 327 as by conductor means 372 and 373 wherein conductor means 373 may have one end connected to conductor means 344, as at a point 374 thereof generally electrically between resistance means 346 and terminal 345, and may have its other end connected to conductor means 327 as at a point 375 thereof generally electrically between resistance means 328 and 329. The emitter 376 of transistor 316 is brought to ground as at 377.

A second operational amplifier 378 has its positive input terminal 379 electrically connected as to conductor means 380, comprising series resistance means 381, leading to ground as at 382. The inverting input terminal 383 of amplifier 378 is electrically connected as by conductor means 384 to one electrical side of capacitor means 385 which has its other electrical side connected as via conductor means 386 and 380 to ground 382. A conductor means 387 serves to electrically interconnect input terminal 379 and conductor means 332 as by having its opposite ends respectively connected to conductor 332, as at a point 388 thereof generally electrically between resistance means 333 and 334, and to conductor 380, as at a point 389 thereof generally electrically between terminal 379 and resistance 381.

The output terminal 390 of amplifier 378 is electrically connected, as via conductor means 391, to conductor means 392 which has its one end electrically connected to conductor means 332 as at a point 393 thereof generally electrically between resistance means 334 and 335. The other end, generally, of conductor 392 is connected as to conductor means 394 and 395 which respectively comprise diode means 396 and resistance means 397, and, diode means 398 and resistance means 399. The other respective ends of conductor means 394 and 395 are each electrically connected to the inverting input terminal 383 as by conductor means 400 which is illustrated as being electrically connected to conductor means 384 as at a point 401 thereof generally electrically between terminal 383 and capacitor means 385.

As depicted, suitable zener diode means 402 may be provided as to regulate the potential across 191 and as across point 306 to points 377 and 424.

In one successful embodiment of the circuit means of FIG. 6, the following elements had the respectively indicated values:

Resistor 312: 100 K
Resistor 315: 100 K
Resistor 317: 100 K
Resistor 328: 1.0 Meg.
Resistor 329: 1.0 Meg.
Resistor 330: 27 K
Resistor 333: 1.0 Meg.
Resistor 334: 1.0 Meg.
Resistor 335: 27 K
Resistor 364: 200 K
Resistor 365: 1.0 Meg.
Resistor 366: 200 K
Resistor 346: 1.0 Meg.
Resistor 381: 1.0 Meg.
Resistor 397: 200 K
Resistor 399: 2.5 Meg.
Capacitor 320: 0.01 μf
Capacitor 323: 0.01 μf
Capacitor 341: 0.10 μf
Capacitor 385: 0.047 μf The integrated circuit portions or amplifiers 338 and 378 actually comprised type LM358 (low power dual operational amplifiers) manufactured by National Semiconductor Corp. of 2900 Semiconductor Drive, Santa Clara, California, U.S.A. and described as at Page 3–148 of the publication entitled "Linear Data Book" and bearing a U.S. of America copyright notice of 1978 by National Semiconductor Corp. If further clarification is desired, terminals 390, 383, 379, 354, 345, 339, 356 and 350 correspond respectively to pins of terminals 1, 2, 3, 4, 5, 6, 7 and 8 of the dual amplifier as depicted in the "connection diagrams" appearing on said Page 3–148 of said publication "Linear Data Book". Diodes 363, 367, 396, 398 and 442 each were of the type IN4001; transistors 314 and 316 were each equivalent of the type 2N4124 manufactured by Texas Instruments Incorporated of Dallas, Texas, U.S.A., and as described as at Page 4–318 of the publication entitled "The Transistor and Diode Data Book", first edition, and bearing a U.S. of America copyright notice of 1973 by Texas Instruments Incorporated. The Darlington-connected transistors 412 and 414 were equivalent of the type 2N5525 manufactured by the said Texas Instruments Incorporated and appearing as on Page 4–442 of said publication "The Transistor and Diode Data Book".

As should be apparent resistance means 364, 365 and 366, amplifier 338, capacitor 341, resistance means 346, resistance means 329 and associated conductor means define an oscillator means wherein resistances 364, 365 and 366 generally collectively cooperate to define feedback resistance means the value of which can be adjustably selected by the wiper contact 368 of the potentiometer means.

Generally, two different situations will exist in the circuit means of FIG. 6. That is, one will exist when the ignition switch means 77 is closed and the vacuum switch means 305 is open while the other operating condition will exist when the ignition switch means 77 and the vacuum switch means 305 are both closed.

Considering first the operating condition wherein ignition switch means is closed but vacuum switch means 305 is opened, it will be seen that ground potential will exist at point 306 because of its connection to ground 318 as by resistor means 317. At this time transistors 314 and 316 are each in a non-conducting state ("off") because the ground potential of point 306 is applied via conductor means 307 and 308 to the base terminals 313 and 319 of transistors 314 and 316, respectively.

Since there is, at this time, no positive voltage being fed from or at emitter 331 of transistor 314, the operational amplifier 378 does not receive the needed positive reference voltage for the non-inverting input terminal 379 thereof and, therefore, the operational amplifier 378 is rendered effectively non-operating and no output is produced at output terminal 390 of amplifier 378.

However, because of the closure of switch means 77, a positive reference voltage is supplied via conductor means 301 to point 348 and such is, in turn, supplied from point 348 by means of resistor 328 to the non-inverting input terminal 345 of operational amplifier 338. Such a reference voltage is supplied as via conductor means 373 to terminal 345 and not brought to ground 377 because, at this time, transistor 316 is off. Consequently, the first oscillator circuit means causes the production of outputs at output terminal 356.

The first oscillator circuit means comprises resistance means 364, 365 and 366, capacitor 341 and operational amplifier 338. Generally, the output at terminal 356 will be either ground potential ("low") or up to supply voltage as, for example, 12.0 volts ("high").

Assuming now, for purposes of illustration, that the output at terminal 356 is "high", current flows from output terminal 356 through diode 363, resistor 364, potentiometer 365, wiper 368, conductor 369, capacitor 341 and conductor 342 to ground 343 thereby charging the capacitor 341. During such charging time the "high" voltage output is also applied via resistor 330 and conductor 337 to the base 420 of Darlington 410 causing the Darlington to go into conduction resulting in the energization of coil 191.

Once the capacitor 341 is sufficiently charged so that the potential on the inverting input terminal 339 starts to exceed the magnitude of the reference voltage at the non-inverting terminal 345, the operational amplifier 338 is effectively switched and the output at terminal 356 thereof becomes "low" resulting in the removal of the forward bias on the base 420 of Darlington 410 causing the Darlington 410 to become non-conductive and consequently de-energizing the solenoid coil. At the same time, the capacitor 341 starts to discharge through the discharging path comprised of conductor 369, wiper 368, potentiometer 365, resistance 366 and diode 367. Such discharging continues until the potential of the inverting input 339 becomes lower than the potential of the non-inverting input terminal 345 and, at that time, the operational amplifier 338 will again be effectively switched and the output at terminal 356 will again become "high" resulting in the repeating of the cycle by again charging capacitor 341.

Now, considering the second condition of operation wherein both switch means 77 and 305 are closed, it will be seen that positive voltage from conductor 303 is applied, via conductor means 307 and 308, to base terminals 313 and 319 of transistors 314 and 316, respectively, causing each transistor 314 and 316 to become conductive and, as will be seen, causing the said first oscillator means to become effectively inoperative while making a second oscillator means operative. The second oscillator means comprises resistor means 397 and 398, capacitor 385 and operational amplifier 378.

In such second condition of operation with both transistors 314 and 316 being conductive, points 374 and 375 are brought effectively to ground potential via conducting transistor 316, while points 388 and 389 are brought effectively to high positive supply voltage as via point 348 and conducting transistor 314.

As a consequence of point 374 being brought to ground potential, the non-inverting input terminal 345 of amplifier 338 has no reference input and therefore the amplifier 338 is rendered effectively non-operative and produces no output as at terminal 356.

However, because of points 388 and 389 being brought to high positive voltage, the non-inverting input terminal 379 of amplifier 378 has the required reference input supplied thereto. This, in turn, results in the said second oscillator means producing outputs at 390 of amplifier 378.

Generally, the output at terminal 390 of amplifier 378 will be either ground potential ("low") or up to supply voltage, as for example, 12.0 volts ("high").

Assuming now, for purposes of description, that the output at terminal 390 is "high", current flows from output terminal 390 through diode 396, resistor 397, capacitor 385 and conductor 386 to ground 382 thereby charging capacitor 385. During such charging time the "high" voltage output is also applied via resistor 335 and conductor 337 to the base 420 of Darlington 410 causing the Darlington to go into conduction and energizing solenoid coil 191.

Once the capacitor 385 is charged so that the potential on the inverting input terminal 383 starts to exceed the magnitude of the reference voltage at the non-inverting terminal 379, the operational amplifier 378 is effectively switched and the output at terminal 390 thereof becomes "low" resulting in the removal of the forward bias on the base 420 of Darlington 410 causing the Darlington 410 to become non-conductive and consequently de-energizing the solenoid coil 191. At the same time, the capacitor 385 starts to discharge through the discharging path comprising resistor 399 and diode 398. Such discharging continues until the potential of the inverting input terminal 383 becomes lower than the potential of the non-inverting input terminal 379 and, at that time, the operational amplifier 378 will again be effectively switched and the output at terminal 390 will again become "high" resulting in the repeating of the cycle by again charging capacitor 385.

Accordingly, it should now be apparent that during the first condition of operation, wherein outputs are produced by amplifier means 338, the length of time that solenoid coil means 191 is energized is a function of the charging time of capacitor means 341 through resistance means 364, potentiometer 365 and wiper 368 while the length of time that solenoid coil means 191 is de-energized is a function of the discharging time of capacitor 341 through wiper 368, potentiometer 365, resistance 366 and diode 367.

It should also be apparent that during the second condition of operation, wherein outputs are produced by amplifier means 378, the length of time that solenoid coil means 191 is energized is a function of the charging time of capacitor means 385 through diode 396, and resistance means 397 while the length of time that solenoid coil means 191 is de-energized is a function of the discharging time of capacitor means 385 through resistance means 399 and diode 398.

With respect to the said second oscillator means, the frequency and percentage of time that a "high" output is, produced are fixed in that the resistance values of resistance means 397 and 399 are fixed. However, with respect to the said first oscillator means, the percentage of time that a "high" output is produced at terminal 356 is variable by the provision of the potentiometer means comprised of potentiometer resistance 365 and wiper 368. Accordingly, it is apparent that with adjustment of the potentiometer wiper 368 generally counter-clockwise as viewed in FIG. 6 that the percentage of time that a "high" output is produced at 356 will decrease and consequently the percentage of time that solenoid coil means 191 is energized will be correspondingly reduced while the percentage of time that a "low" output is produced at 356 and the precentage of time that solenoid coil means 191 will be de-energized will increase. In like manner, if the potentiometer wiper 368 is selectively adjusted generally clockwise as viewed in FIG. 6, the percentage of time that a "high" output is produced at 356 and the percentage of time that solenoid coil means 191 will be energized will increase while the percentage of time that a "low" output is produced at 356 and the percentage of time the solenoid coil is de-energized will decrease.

In the embodiment of the invention as depicted in FIG. 3, it is clear that valving member 227 will be seated and closing fuel flow through passage means 171 only when solenoid winding 191 is energized, and, as already hereinbefore explained, energization of the winding or coil 191 occurs only when and during the time that the output of either amplifier 338 or 378 is "high". In the preferred embodiment of the invention, the values selected in the said first oscillator circuit means are such as to enable a selection of from 30 percent to 80 percent duty cycle. That is, in the overall cycle time of the first oscillator circuit means, the output at 356 would be "high" (and solenoid winding 191 would be energized) anywhere (selective from 30 to 80 percent of such cycle time. Also, in the preferred embodiment of the invention, the circuit constants of the said second oscillator circuit means are such as to produce a 10 percent duty cycle. That is, in the overall cycle time of the second oscillator circuit means, the output at 390 would be "high" (and solenoid winding 191 would be energized) during 10 percent of such cycle time.

Further, as generally depicted in FIG. 6, the pressure responsive means 540 of the vacuum responsive switch means 305 is operatively connected as via conduit means 542 to a source of engine intake manifold vacuum as through cooperating passage means 544 (FIG. 2).

Figure 4:
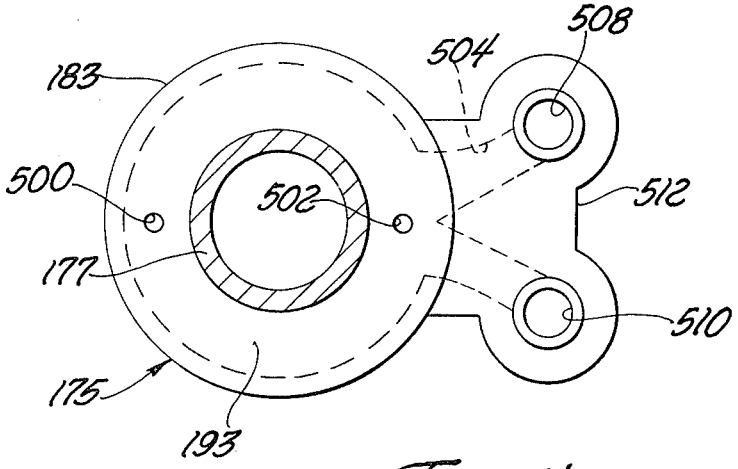
FIG. 4 is a cross-sectional view taken generally on the plane of line 4—4 of FIG. 3 and looking in the direction of the arrows.

Although various arrangements are, of course, possible, in the preferred embodiment the coil 191 leads 197 and 199 (FIG. 3) may pass through suitable clearance or passage means 500 and 502 (FIG. 4) and pass through relieved portions 504, 506 (formed as in integrally formed arm portion 512) and then be respectively received as within eyelets 508, 510 which also respectively receive enlarged conductor extensions of such leads 197 and 199 (one of such being partly depicted at 514 in FIG. 3) Such extensions may, of course, be brought out of the carburetor housing means in any suitable manner as to thereby, in effect, respectively comprise the conductor means 197 and 199 as depicted in FIG. 6.

OPERATION OF INVENTION

Referring in particular to both FIGS. 2 and 3, it can be seen that when solenoid coil 191 is energized causing the valving element 227 to be seated, closing passage means 171, the upper disposed valving element 213 is moved fully away from its seated engagement and fully opening passage 147. In this position of the valving means fuel flow through main fuel passage means 171 is terminated while maximum flow of idle fuel bleed air is permitted. Such bleed air flow occurs as from inlet 132 (FIG. 2), through conduit means 130, conduit means 122, passage means 147, 145, passage or aperture means 143, conduit means 120, 124 and 128 and a portion of conduit means 86. Such, of course, is in addition to the bleed air flow provided via conduit means 98. This, of course, results in the leanest ( in terms of fuel) idle fuel flow being metered to the engine.

In comparison, when solenoid coil 191 is de-energized, spring means 229 moves valving element 213 upwardly as to be seated closing passage 147 while at the same time moving valving element 227 fully away from passage 171 thereby fully opening passage 171 and allowing the maximum rate of metered main fuel flow therethrough. Because of the closure of passage 147 by valving element 213, the rate of flow of idle bleed air is reduced to a minimum with such being determined by the metering action through passage means 98 (FIG. 2). This, of course, results in the richest (in terms of fuel) idle fuel flow being metered to the engine.

Accordingly, it can be seen that, during a selected span of time, the richness of the idle fuel flow and of the main fuel flow will depend upon the frequency and/or duration of the energization of solenoid coil means 191. That is the greater the percentage of time that coil means 191 is energized the leaner, in terms of fuel, is the fuel-air ratio delivered to the engine and the lesser the percentage of time that coil means 191 is energized the richer, in terms of fuel, is the fuel-air ratio delivered to the engine.

Now assuming the vehicle is being operated under generally normal road-load conditions (at this time, of course, ignition switch 77 is closed and vacuum operated switch means 305 is open), the vehicle operator may actuate the appropriate pushbutton on the device 29 to obtain a read-out at the display 69 indicating the then miles-per-gallon being obtained. The vehicle operator may then turn the control knob 71, for example, counterclockwise (to a more richer fuel-air mixture) as viewed in either FIGS. 1 or 6, and observe the miles-per-gallon read-out to see if the fuel economy of the vehicle (engine) improves or decreases. If an improvement in the fuel economy is observed, further adjustment in that same direction may be continued until a maximum improvement is realized. If a decrease in fuel economy is observed, the operator may, instead, adjust the control knob 71 generally clockwise (to a leaner fuel-air mixture) as viewed in either FIGS. 1 or 6, and observe the miles-per-gallon readout to see if the fuel economy of the vehicle (engine) improves or decreases. Obviously, if an improvement in the fuel economy is observed, further adjustment in that same direction may be continued until a maximum improvement is realized.

Accordingly, it can be appreciated that with the invention a vehicle operator is, within limits, able to manually select the rate of metered fuel flow to the engine which will provide the greatest fuel economy for the then operating conditions. This, of course, means that such factors as, for example: strong vehicular head winds; varying altitudes of vehicular operation; heavier vehicle loads as, for example, pulling a trailer or the like; varying ambient temperatures and varying brands and quality of gasoline (or other fuels) may, to a great extent be compensated for during actual vehicle (engine) operation as to obtain maximum fuel economy.

In the preferred embodiment of the invention, the various circuit constants of FIG. 6 as well as the fluid circuit constants of the fuel metering circuits are selected so that regardless of whether the vehicle operator adjusts control knob 71 to produce a maximum rich (in terms of fuel) fuel-air ratio supplied to the engine or a maximum lean (in terms of fuel) fuel-air ratio supplied to the engine, the resulting engine exhaust emissions will still be within the limits set by the governmental authorities. The graph of FIG. 5 generally depicts fuel-air ratio curves obtainable by the invention. For purposes of illustration, let it be assumed that curve 200 represents a combustible mixture, metered as to have a ratio of 0.068 lbs. of fuel per pound of air. Then, as generally shown, the invention could (depending upon the degree and direction of adjustment of knob 71 by the operator) provide a flow of combustible mixtures in the range anywhere from a selected lower-most fuel-air ratio (80 percent duty cycle operation of the said first oscillator circuit means) as depicted by curve 202 to a selected upper-most fuel-air ratio (30 percent duty cycle operation of the said first oscillator circuit means) as depicted by curve 204. As should be apparent, the invention is capable of providing an infinite family of such fuel-air ratio curves between and including curves 202 and 204. The portions of curves 202 and 204 respectively between points 212 and 214 and points 212, 208 are intended to depict, generally, what may be considered as the idle range of operation.

Figure 5:
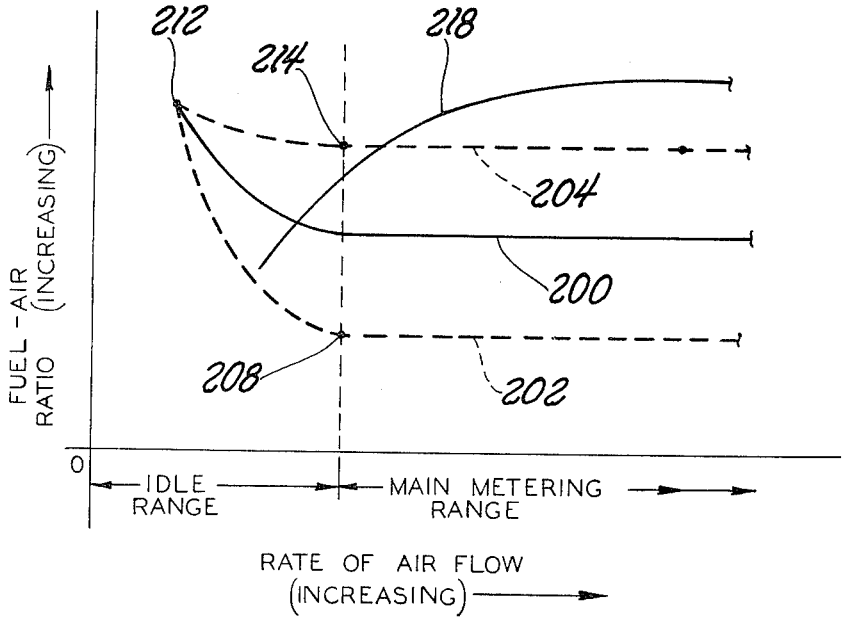
FIG. 5 is a graph illustrating, generally, fuel-air ratio curves obtainable with structures employing teachings of the invention.

Now, let it be assumed that the vehicle is still operating and that the vehicle operator desires to undergo maximum acceleration as to, for example, pass another vehicle. As the vehicle operator causes the throttle valve 52 to, for example, wide open position, the magnitude of the intake manifold vacuum decreases and such decreased magnitude, in turn, causes the switch means 305 to close, and as previously described, causing the said first oscillator circuit means to become effectively inoperative (no pulsed outputs at 356) and simultaneously causing the said second oscillator circuit means to become operative (pulsed outputs at 390). Also as previously described when the said second oscillator circuit means becomes operative it has a generally constant 10 percent duty cycle which provides the richest possible fuel-air ratio and, in fuel richness, exceeds the maximum fuel richness which can be provided by the fuel metering system during the time that the said first oscillator circuit means is operational. In FIG. 5 the curve 218 (which may be considered a wide open throttle fuel-air ratio curve) is intended to represent the fuel-air ratio deliverable during such a 10 percent duty cycle operation.

In the preferred embodiment of the invention, the vacuum responsive switch means 305 is such as to be closed whenever the magnitude of the intake manifold vacuum is equal to or less than 6.0 inches of Hg. However, the magnitude of engine vacuum at which switch means 305 closes is, of course, a value which may be selected to best suit the particular associated engine. Further, even though switch means 305, in the preferred embodiment, is pressure responsive, it should be apparent that other means (not pressure responsive) may be employed for sensing when, for example, wide open or nearly wide open throttle engine operation is required, and, in response thereto causing closure of switch means 305 as to functionally inactivate the said first oscillator circuit means and to activate the said second oscillator circuit means.

It should also be apparent that the invention may be practiced employing electrical control circuit means other than that as at 160 of FIG. 6.

Although only a preferred embodiment of the invention has been disclosed and described, it is apparent that other embodiments and modifications of the invention are possible within the scope of the appended claims.

What is claimed is:

1. Fuel metering apparatus for a combustion engine which produces output power as a consequence of combustion air and fuel being supplied thereto, said fuel metering apparatus comprising fuel metering means effective for metering fuel to said engine as to attain at least a first fuel-air ratio based on the rate of air flow to said engine, and manually selectively controlled electrical adjustment means effective for causing said fuel metering means to meter fuel to said engine at rates of metered fuel flow which based on the rate of air flow to said engine results in second fuel-air ratios different from said first fuel-air ratio.

2. Fuel metering apparatus according to claim 1 wherein said second fuel-air ratios different from said first fuel-air ratio is of a numerical value less than the numerical value of said first fuel-air ratio.

3. Fuel metering apparatus according to claim 1 wherein said second fuel-air ratios different from said first fuel-air ratio is of a numerical value greater than the numerical value of said first fuel-air ratio.

4. Fuel metering apparatus according to claim 1 and further comprising override means responsive to an indicium of a preselected condition of engine load for causing said fuel metering means to meter fuel to said engine at a rate of metered fuel flow which when based on the rate of air flow to said engine during said preselected condition of engine load results in a third fuel-air ratio greater than either said first or second fuel-air ratios.

5. Fuel metering apparatus according to claim 1 and further comprising sensory indicator means for indicating to the engine operator whether said first fuel-air ratio or said second fuel-air ratios are providing a more fuel-efficient fuel-air ratio to said engine.

6. Fuel metering apparatus according to claim 1 and further comprising a carburetor structure, said carburetor structure comprising an induction passage, wherein said air being supplied to said engine flows through said induction passage, wherein said fuel metering means comprises a fuel metering system operatively carried by said carburetor structure, a source of fuel, said fuel metering system communicating generally between said source of fuel and said induction passage, said fuel metering system comprising a fuel-flow orifice and valving means, said valving means comprising electrically energizable solenoid means, a valve member operatively connected to said solenoid means, said solenoid means being effective during operation of said engine to oscillatingly move said valve member toward and away from said orifice in order to thereby cause a selected restricting effect on the flow of fuel through said orifice, and wherein said manually selectively controlled electrical adjustment means is effective for selectively varying the relative percentage of time that said valve member is away from said orifice in the overall cycle of oscillation of said solenoid means.

7. Fuel metering apparatus according to claim 6 wherein said fuel metering system further comprises a second calibrated orifice, and wherein said fuel-flow orifice and said second orifice are in parallel fluid circuit relationship to each other as to have each communicate with said source of fuel.

8. Fuel metering apparatus for a combustion engine which produces output power as a consequence of combustion air and fuel being supplied thereto, said fuel metering apparatus comprising fuel metering means effective for metering fuel to said engine as to attain at least a first fuel-air ratio based on the rate of air flow to said engine, manually selectively controlled electrical adjustment means effective for causing said fuel metering means to meter fuel to said engine at rates of metered fuel flow which based on the rate of air flow to said engine results in second fuel-air ratios different from said first fuel-air ratio, and a carburetor structure, said carburetor structure comprising induction passage means, wherein said air being supplied to said engine flows through said induction passage means, wherein said fuel metering means comprises a main fuel metering system operatively carried by said carburetor structure and an idle fuel metering system operatively carried by said carburetor structure, a source of fuel, said main fuel metering system communicating generally between said source of fuel and said induction passage means, said main fuel metering system comprising a first orifice and cooperating first valve member, electrically energizable solenoid means, said first valve member being operatively connected to said solenoid means, said solenoid means being effective during operation of said engine to oscillatingly move said first valve member toward and away from said first orifice in order to thereby cause a selected restricting effect on the flow of fuel through said first orifice, said idle fuel metering system communicating generally between said source of fuel and said induction passage means, said idle fuel metering system comprising idle fuel conduit means effective for discharging fuel from said source of fuel into said induction passage means, idle fuel inlet means communicating with said idle fuel conduit means and said source of fuel, said idle fuel inlet means comprising second orifice means, air bleed means communicating with said idle fuel conduit means, a second valve member effective for cooperating with said air bleed means to controllably alter the rate of flow of bleed air through said bleed means and to in response thereto controllably alter the metered rate of fuel flow from said sources of fuel through said idle fuel conduit means, said second valve member being operatively connected to said solenoid means as to oscillatingly move with said first valve member whereby when said first valve member is oscillatingly moving toward said first orifice said second valve member is oscillatingly moving away from said air bleed means to more fully open said air bleed means to the flow of bleed air therethrough and whereby when said first valve member is oscillatingly moving away from said first orifice said second valve member is oscillatingly moving toward said air bleed means to more fully close said air bleed means to the flow of bleed air therethrough, and wherein said manually selectively controlled adjustment means is effective for selectively varying the relative percentage of time that said first valve member is away from said first orifice in the overall cycle of oscillation of said solenoid means.

9. Fuel metering apparatus according to claim 8 wherein said main fuel metering system further comprises a third orifice, and wherein said first orifice and said third orifice are in parallel fluid circuit relationship to each other as to have each communicate with said source of fuel.

10. Fuel metering apparatus according to claim 8 wherein said air bleed means comprises first and second air bleed passages communicating with ambient atmosphere, wherein said first air bleed passage is in constant open communication with said ambient atmosphere, and further comprising air bleed orifice means communicating with said second air bleed passage, and wherein said second valve member when oscillatingly being moved moving toward and away from said air bleed orifice means.

11. Fuel metering apparatus for a combustion engine which produces output power as a consequence of combustion air and fuel being supplied thereto, said fuel metering apparatus comprising fuel metering means effective for metering fuel to said engine at to attain at least a first fuel-air ratio based on the rate of air flow to said engine, and manually selectively controlled electrical adjustment means effective for causing said fuel metering means to meter fuel to said engine in a plurality of rates of metered fuel flows with each of said plurality of rates being different from the others of said plurality of rates and different from the rate of metered fuel flow resulting in said first fuel-air ratio.

12. Fuel metering apparatus according to claim 11 and further comprising sensory indicator means for indicating to the engine operator whether said first fuel-air ratio or one of said plurality of rates of metered fuel flows is providing a more fuel-efficient fuel-air ratio to said engine.

13. Fuel metering apparatus according to claim 11 and further comprising override means responsive to an indicium of a preselected condition of engine load for causing said fuel metering means to meter fuel to said engine at a rate of metered fuel flow which when based on the rate of air flow to said engine during said preselected condition of engine load results in a third fuel-air ratio of the fuel and air being supplied to said engine which is greater than said first fuel-air ratio or any of fuel-air ratios resulting from said plurality of rates of metered fuel flows.

14. Fuel metering apparatus according to claim 12 and further comprising override means responsive to an indicium of a preselected condition of engine load for causing said fuel metering means to meter fuel to said engine at a rate of metered fuel flow which when based on the rate of air flow to said engine during said preselected condition of engine load results in a third fuel-air ratio of the fuel and air being supplied to said engine which is greater than said first fuel-air ratio or any of fuel-air ratios resulting from said plurality of rates of metered fuel flows.

15. Fuel metering apparatus according to claim 11 wherein said plurality of rates of metered fuel flows results in a plurality of respective fuel-air ratios of the fuel and air being thereby supplied to said engine, and wherein at least certain of said plurality of respective fuel-air ratios are less than said first fuel-air ratio when supplied to said engine.

16. Fuel metering apparatus according to claim 15 and further comprising sensory indicator means for indicating to the engine operator whether said first fuel-air ratio or one of the fuel-air ratios resulting from any of said plurality of rates of metered fuel flows is providing a more fuel-efficient fuel-air ratio to said engine.

17. Fuel metering apparatus according to claim 11 wherein said plurality of rates of metered fuel flows results in a plurality of respective fuel-air ratios of the fuel and air being thereby supplied to said engine, and wherein at least certain of said plurality of respective fuel-air ratios are greater than said first fuel-air ratio when supplied to said engine.

18. Fuel metering apparatus according to claim 17 and further comprising sensory indicator means for indicating to the engine operator whether said first fuel-air ratio or one of the fuel-air ratios resulting from any of said plurality of rates of metered fuel flows is providing a more fuel-efficient fuel-air ratio to said engine.

19. Fuel metering apparatus according to claim 18 and further comprising override means responsive to an indicium of a preselected condition of engine load for causing said fuel metering means to meter fuel to said engine at a rate of air flow to said engine during said preselected conditon of engine load results in a third fuel-air ratio of the fuel and air being supplied to said engine which is greater than said first fuel-air ratio or any of fuel-air ratios resulting from said plurality of rates of metered fuel flows.

20. In combination, a vehicle, said vehicle comprising a combustion engine operatively connected to ground-engaging drive wheel means, induction passage means for supplying motive fluid to said engine, a source of fuel, fuel metering system means communicating generally between said source of fuel and said induction passage means, said fuel metering system means comprising valving means for controlling the rate of metered fuel flow from said source of fuel to said induction passage means as to attain at least a first fuel-air ratio, and manually controlled adjustment means operatively connected to said valving means, said manually controlled adjustment means being effective to alter the operation of said valving means as to thereby alter the rate of fuel flow from said source of fuel to said induction passage means as to result in any of a plurality of fuel-air ratios each of which differs from each other and from said first fuel-air ratio.

21. The combination according to claim 20 wherein said valving means comprises solenoid means, wherein said manually controlled adjustment means comprises electrical circuit means, wherein said electrical circuit means is operatively connected to said solenoid means, and wherein the energization of said solenoid means is varied by said electrical circuit means as to thereby alter said operation of said valving means.

22. The combination according to claim 20 wherein said manually controlled adjustment means is effective to selectively cause said valving means to alter said rate of metered fuel flow to said engine between upper and lower limits of fuel-air ratios, and further comprising in combination means responsive to increased engine loads for further altering the rate of metered fuel flow to said engine whereby the rate of fuel flow exceeds the said upper limit of fuel-air ratio.

23. The combination according to claim 20 and further comprising in combination sensory indicator means indicative of the rate of fuel consumption of said engine in terms of distance traveled by said vehicle, and wherein said sensory indicator means is effective to indicate when said manually controlled adjustment means is being adjusted in a manner resulting in a decreased rate of fuel consumption in terms of distance traveled.

* * * * *